US005085126A

United States Patent [19]

Mukoyama

[11] Patent Number: 5,085,126

[45] Date of Patent: Feb. 4, 1992

[54] PNEUMATIC PERCUSSION TOOL WITH RELATIVELY MOVABLE HEAD VALVES

[75] Inventor: Kenzi Mukoyama, Anjo, Japan

[73] Assignee: Makita Electric Works, Ltd., Anjo, Japan

[21] Appl. No.: 639,246

[22] Filed: Jan. 8, 1991

[30] Foreign Application Priority Data

Jan. 10, 1990 [JP] Japan ..... 2-3847

[51] Int. Cl.[5] ..... F15B 11/08; F15B 13/04

[52] U.S. Cl. ..... 91/426; 91/442; 91/444; 91/461; 91/468

[58] Field of Search ..... 91/5, 417 A, 426, 442, 91/444, 446, 447, 448, 461, 468

[56] References Cited

U.S. PATENT DOCUMENTS

| | | | |
|---|---|---|---|
| 3,056,964 | 10/1962 | Beckman et al. | 91/461 X |
| 3,313,213 | 4/1967 | Wandel | 91/468 X |
| 3,392,632 | 7/1968 | Volkmann | 91/461 X |
| 3,396,636 | 8/1968 | Bade | 91/461 X |
| 3,437,013 | 4/1969 | Volkmann | 91/461 |
| 4,667,572 | 5/1987 | Elliesen | 91/461 |

*Primary Examiner*—Edward K. Look
*Assistant Examiner*—John Ryznic
*Attorney, Agent, or Firm*—Dennison, Meserole, Pollack & Scheiner

[57] ABSTRACT

A pneumatic percussion tool includes a head valve device including first and second head valves disposed in the body and movable in response to the pressure variation in the head valve chamber. The first and second head valves are positioned at a first position for preventing communication between the main air chamber and the percussion piston chamber while permitting communication between the percussion piston chamber and the outside of the body and preventing communication between the head valve chamber and the outside of the body when the compressed air is introduced into the head valve chamber through the change-over valve. The first and second head valves are movable from the first position to a second position for permitting communication between the main air chamber and the percussion piston chamber while preventing communication between the percussion piston chamber and the outside of the body and between the head valve chamber and the outside of the body when the compressed air has been discharged to the outside through the change-over valve. The first and second head valves are movable relative to each other for permitting communication between the head valve chamber and the outside of the body and for preventing communication between the percussion piston chamber and the outside of the body during the movement from the first position to the second position.

12 Claims, 6 Drawing Sheets

PNEUMATIC PERCUSSION TOOL WITH RELATIVELY MOVABLE HEAD VALVES

BACKGROUND OF THE INVENTION

1. Field of the Invention

This invention relates to a pnuematic percussion tool such as a nailing machine having a head valve device for controlling the supply and discharge of compressed air which is utilized for reciprocally moving a percussion piston for driving a nail etc. into a work.

2. Description of the Prior Art

Japanese Patent Publication No. 57-57234 discloses a pneumatic nailing machine including a body, a cylinder mounted within the body, a percussion piston connected with a driver for percussion operation and reciprocally movable within the cylinder, a percussion piston chamber formed in the body adjacent one of the stroke ends of the percussion piston and communicating with the cylinder, a main air chamber formed in the body adjacent the percussion piston chamber for storing compressed air supplied from a compressed air source, and a head valve device mounted on the body for permitting or preventing communication between the percussion piston chamber and the main air chamber and for permitting or preventing communication betwen the percussion piston chamber and the outside, a head valve chamber formed in the body opposed to the percussion piston chamber, a head valve disposed between the percussion piston chamber and the head valve chamber and movable in response to the pressure difference therebetween, an outlet port formed in the body for communication between the percussion piston chamber and the outside through the head valve, a passage formed in the body for supllying the compressed air from the air source to the head valve chamber, and a trigger valve connected with the end of the passage for selectively connecting the same with the air source or the outside.

The trigger valve is operable by a trigger and the trigger valve is normally held in a position to connect the passage with the air source, so that the compressed air is supplied to the head valve chamber for keeping the head valve in a first position to prevent communication between the main air chamber and the percussion piston chamber and to permit communication between the percussion piston chamber and the outside. In this stage, the percussion piston is positioned at the stroke end adjacent the percussion piston chamber (the upper stroke end).

When the trigger is pulled to connect the passage with the outside, the head valve is moved by the pressure difference between the main air chamber and the head valve chamber from the first position to a second position in which the head valve prevents communication between the percussion piston chamber and the outside while permitting communication between the main air chamber and the outside of the body. The percussion piston is therefore moved toward another stroke end so as to perform the nailing operation.

The trigger is therafter released to connect the passage with the compressed air source, so that the head valve is moved to return the first position and the percussion piston returns to the upper stroke end.

In the nailing operation of this prior art, the compressed air stored in the head valve chamber is exhausted only through the passage connecting the trigger valve. Therefore, the compressed air cannot be smoothly and rapidly exhausted from the head valve chamber. This may cause delay of movement of the head valve for supplying the air from the main air chamber to the percussion piston chamber, so that the nailing force of the percussion piston is lowered. This may further cause unreliable movement of the percussion piston, so that the nailing machine cannot be used for momentary nailing operation.

Japanese Patent Publication No. 58-48310 discloses a head valve device including a first and a second head valve. A passage connecting a trigger valve with a head valve chamber is connected with the head valve chamber through a first and second channel formed in a body. A third channel is formed in the body for supplying air from a main air chamber to a gap between the first and second head valves. When a trigger is operated to change the trigger valve for opening the passage into the outside, the air in the head valve chamber is exhausted through the passage via the first and second channels while the air supplied to the gap between the first and seocnd chamber moves the first head valve upwardly away from the first head valve. When the first head valve reaches its uppermost position to close the first channel, the air supplied into the gap flows into the second channel, so that the second head valve is moved upwardly for communication between the main air chamber and a percussion piston chamber by the pressure difference between the gap and the main air chamber. The third channel is closed by the second head valve when the second head valve reaches its uppermost position.

Thus, in this prior art, the air pressure in the main air chamber is used to positively move the first head valve. The communication between the main air chamber and the percussion piston chamber is, however, made by the movement of the second head valve baded on the pressure difference between the gap and the main air chamber.

The air flown into the gap from the main air chamber is exhausted to the outisde through the second channel and the passage when the first head valve reaches its upper most position. Therefore, leakage of the air is caused in the main air chamber. Further, the second head valve cannot be moved rapidly since the pressure difference between the gap and the main air chamber is relatively small because of the presence of the flow of air from the main air chamebr to the gap at the first stage.

Japanese Utility Model Publication No. 58-45025 discloses a head valve device having a head valve which includes a communication hole in a radial direction for communiction between a percussion piston chamber and an outlet port formed in a body. An annular recess is formed on the inner surface of the head valve chamber. The annular recess permits communication between the head valve chamber and the outlet port through the communication hole when the seal member mounted on the head valve moves into the annular recess. Thus, the compressed air stored in the head valve chamber may be exhausted through the outlet port based on the movement of the head valve passage conneting the head valve chamber and a trigger valve as well as the outlet port when the trigger has been changed to the outside.

However, the compressed air supplied into the head valve for returning the head valve for preventing communication between the main air chamber and the percussion piston chamber may also escape from the outlet port when the seal member has moved into the annular recess. Therefore, this may cause leakage of the air.

SUMMARY OF THE INVENTION

It is, accordingly, an object of the present invention to provide a pneumatic percussion tool in which the compressed air stored in a head valve chamber can be rapidly exhausted to the outside for communication between a main air chamber and a percussion piston chamber, so that the percussion force of a percusssion piston may be increased.

It is another object of the present invention to provide a pneumatic percussion tool in which any leakage of the compressed air stored in the main air chamber or the head valve may not occur throughout the movement of the head valve.

According to the present invention, there is provided a pneumatic percussion tool comprising:

a body;

a cylinder mounted within the body;

a percussion piston connected with a driver for percussion operation and reciprocally movable within the cylinder;

a percussion piston chamber formed in the body and communicating with the cylinder at a stroke end of the percussion piston;

a main air chamber formed in the body for storing compressed air supplied from a compressed air source;

a head valve chamber formed in the body;

a change-over valve operable by an operator for selectively connecting the head valve chamber with the compressed air source or the outside of the body; and a head valve device disposed in the body for interconnecting the percussion piston chamber, the main air chamber, the head valve chamber and the outside of the body.

The head valve device comprises:

first and second head valves disposed in the body and movable in response to the pressure variation in the head valve chamber;

The first and second head valves are positioned at a first position for preventing communication between the main air chamber and the percussion piston chamber while permitting communication between the percussion piston chamber and the outside of the body and preventing communication between the head valve chamber and the outside of the body when the compressed air is introduced into the head valve chamber through the change-over valve.

The first and second head valves are movable from the first position to a second position for permitting communication between the main air chamber and the percussion piston chamber while preventing communication between the percussion piston chamber and the outside of the body and between the head valve chamber and the outside of the body when the compressed air has been discharged to the outside through the change-over valve.

The first and second head valves are movable relative to each other for permitting communication between the head valve chamber and the outside of the body and for preventing communication between the percussion piston chamber and the outside of the body during the movement from the first position to the second position.

Preferably, the first head valve moves from the first position to the second position for communication between the head valve chamber and the outside of the body prior to the movement of the second head valve. The first and second head valves cooperate in such a manner that the second head valve continues to prevent communication between the main air chamber and the percussion piston chamber when the first head valve moves for communication between the head valve chamber and the outside of the body prior to the movement of the second head valve.

The first and second head valves further cooperate to prevent communication between the percussion piston chamber and the outside of the body and to subsequently permit communication between the main air chamber and the percussion piston chamber after the first and second valves have permitted communication between the head valve chamber and the outside of the body.

The first and second head valves are coaxial annular members which are slidably movable relative to each other and along corresponding inner and outer walls formed on the body in an axial direction. The first head valve includes a surface for receiving a pressure of the compressed air stored in the main air chamber in a direction toward the second position. Means are provided between the first and second head valves for moving the second head valve toward the second position following the first head valve after the first head valve has moved a predetermined distance toward the first position.

The means for moving the second head valve toward the second position are stepped portions formed on the first and second head valves opposed to each other.

The second head valve is moved by the pressure of the air introduced into the percussion piston chamber to the second position after the first head valve has reached the second position.

The first head valve is normally biased by a spring toward the first position.

The first head valve includes two sets of at least one first channel extending in a radial direction and each having one end opened to the outlet port and the other end opened to the second head valve. The second head valve includes at least one second channel extending in a radial direction for communication between the percussion piston chamebr and the outside of the body in cooperation with one of the sets of the first chamber when the first head valve moves from the first position toward the second position until the second head valve follows the first head valve. The first head valve and the second head valve form therebetween a third channel when the first head valve moves from the first position toward the second position until the second head valve follows the first head valve for communication between the head valve chamber and the outside of the body in cooperation with another set of the first channel.

The communication between one of the sets of the first channel may be prevented by the engagement of the stepped portions formed on the first and second head valves opposed to each other for moving the second head valve toward the second position.

The second channel is closed by the corresponding wall of the body immediately after the second head valve haa moved from the first position toward the second position.

The first head valves moves from the second position toward the first position prior to the movement of the second head valve by the pressure of the compressed air entered into the head valve chamber so as to prevent communication between the main air chamber and the percussion piston chamber when the change over valve is changed to the compressed air source after the first and second head valves have reached the second position, respectively. The second head valve subsequently moves toward the first position so as to permit communication between the percussion piston chamber and the outside of the body.

The first head valve is movable from the second position toward the first position by the pressure of air lower than that necessary for moving the first head valve in the same direction.

The invention will become more fully apparent from the claims and the description as it proceeds in connection with drawings.

DETAILED DESCRIPTION OF THE PREFERRED EMBODIMENT

Figure 1:
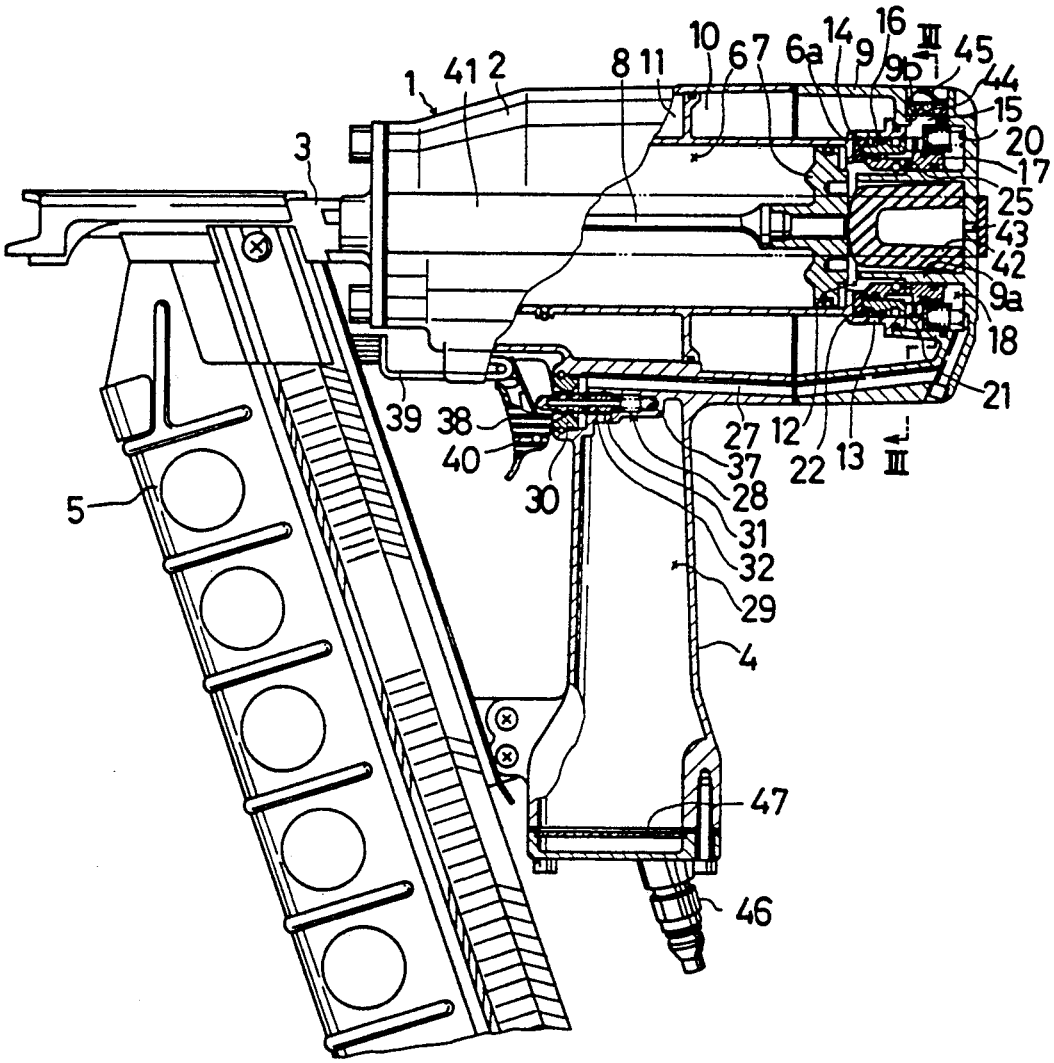
FIG. 1 is a front view of a nailing machine according to an embodiment of the present invention with a part of the body and the handle broken away.

Referring to FIG. 1, there is shown a pneumatic nailing machine according to an embodiment of the present invention.

In general, the nailing machine includes a body 1 forming a body housing 2 which accomodates a drive mechanism as will be hereinafter explained. The nailing machine further includes a driver guide 3 mounted on one end of the body housing 2, a handle 4 integrally formed with the body housing 2 and extending radially outwardly from the central portion of the body housing 2 in a longitudinal direction thereof, and a magazine 5 (partly shown in FIG. 1) accomodating a plurality of nails and extending obliquely to the body hausing 2. The magazine 5 is joined at one end thereof to one end of the driver guide 3 and at the middle portion thereof to the handle 4.

A cylinder 6 is formed within the body housing 2 and extends in a longitudinal direction of the body housing 2. A percussion piston 7 is disposed within the cylinder 6 and is slidably movable in the longitudinal direction. A driver 8 extends through the percussion piston 7 on its central axis into the driver guide 3 and is fixed to the percussion piston 7. A head housing 9 is mounted on the other end of the body housing 2. A main air chamber 10 and a return air chamber 11 are formed within the body housing 2. The main air chamber 10 and the return air chamber 11 are disposed outwardly of the cylinder 6 and are separated from each other. The main air chamber 10 extends from substantially the central portion of the body housing 2 to the head housing 9 while the return air chamber 11 extends from substantially the central portion of the body housing 2 to the end of the body housing 2 opposite to the head housing 9.

The cylinder 6 is formed with a partition wall 6*a*, while the head housing 9 is formed with an inner partition wall 9*a* and an outer partition wall 9*b* which are coaxially disposed. A percussion piston chamber 12 is formed on the side of the head housing 9 and is separated from the main air chamber 10 by the partition wall 6*a* and the inner partition wall 9*a*. The percussion piston chamber 12 is communicated with the main air chamber 10 through a plurality of first communication holes 13 which are formed on the partition wall 6*a* and are disposed in a circumferential direction of the partition wall 6*a* at the middle portion thereof. An annular portion 6*a*1 is formed with the partition wall 6*a* for defining an end of stroke of the percussion piston 7, and the percussion piston chamber 12 is communicated with the interior of the cylinder 6 through the annular portion 6*a*1. A valve seat 14 is mounted on the annular portion 6*a*1 on the side of the percusssion piston chamber 12. The percussion piston chamber 12 is communicated with the outside of the body 1 through an outlet port 15 which is positioned at the middle portion of the percussion piston chamber 12 and extends in a radial direction thereof. A first head valve 16 and a second head valve 17 are disposed in the percussion piston chamber 12 and are slidably movable in a longitudinal direction thereof. The first head valve 16 is cylindrical and includes a first portion 16*a* of small diameter and a second portion 16*b* of large diameter. The outer surface of the first portion 16*a* is slidably in contact with the inner surface of the partition wall 6*a*, and one end of the first portion 16*a* is oppposed to the valve seat 14. The outer surface of the second portion 16*b* is slidably in contact with the inner surface of the outer partition wall 9*b* of the head housing 9. One end of the second portion 16*b* extends into a valve chamber 18 formed between the inner partition wall 9*a* and the outer paratition wall 9*b* on the side opposite to the valve seat 14. The one end of the second portion 16*b* is opposed to the inner wall of the valve chamber 18 extending substantially perpendicular to the longitudinal direction. Four recesses 19 are formed on the end surface of the second portion 16*b* and are equally separated from each other in a circumferential direction. Each of the recesses 19 receives one end of a compression spring 20, the other end of which abuts on the inner wall of the valve chamber 18. Thus the first head valve 16 is urged in a direction toward the valve seat 14 so that the one end of the first portion 16*a* normally abuts on the valve seat 14. A plurality of first channels 21 are formed at the other end of the first portion 16*a* of the first head valve 16 next to the second portion 16*b* for communication between the interior of the percussion piston chamber 12 and the outlet port 15. The first channels 21 are arranged in two rows in a circumferential direction of the first portion 16*a*. The one end of the first portion 16*a* includes a surface 22 which may receive pressure of compressed air supplied from the main air chamber 10. A seal member 23*a* such as an O-ring is provided between the first head valve 16 and the partition wall 6*a* in the vicinity of the surface 22 for keeping air tight. The head valve 16 includes on the inner surface thereof a stepped portion 16*c* in the vicinity of the first outlet channels 21 so that the inner surface has a large diameter in a range between the stepped portion 16*c* and the one end of the second portion 16*b*. A seal member 23*b* such as an O-ring is provided between the partition wall 6*b* and the second portion 16*b* of the head valve 16 for keeping air tight.

The second head valve 17 is cylindrical and is inserted within the first head valve 16. The second head valve 17 includes on the outer surface thereof a stepped portion 17*a* at the middle portion in a longitudinal direction. Thus, the second head valve 17 includes a first portion 17*b* of small outer diameter and a second portion 17*c* of large outer diameter. The stepped portion 17*a* of the second head valve 17 is opposed to the stepped portion 16*c* of the first head valve 16. The outer surface of the first portion 17*b* is in slidably contact with the inner surface of the first portion 16*a* of the first head valve 16. The inner partition wall 9*a* includes a first portion 9*a*1 of small outer diameter and a second portion 9*a*2 of large diameter so as to form a stepped portion therebetween. The inner surface of the first portion 17*b* of the second head valve 17 is opposed to the first portion 9*a*1 of the inner partition wall 9 and is spaced therefrom at a predetermined distance. The end of the first portion 17*b* is opposed to the valve seat 14. The outer surface of the second portion 17*c* is slidably in contact with the inner surface of the second portion 16*b* of the first head valve 16. The inner surface of the second portion 17*c* is slidably in contact with the second portion 9*a*2 of the inner partition wall 9*a*. The end of the second portion 17*c* extends into the valve chamber 18 and is opposed to the inner surface of the chamber 18.

A recess 24 is formed on the outer surface of the first portion 17*b* of the second head valve 17 and extends in a longitudinal direction from the stepped portion 17*a* at a suitable distance. A plurality of second channels 25 are formed in the first portion 17*b* in a radial direction and are spaced from each other in a circumferential direction. The second channels 25 are connected with the recess 24 for connection of the percussion piston chamber 12 with the first channels 21 as will be hereinafter described. One end of the first portion 17*b* is formed to have smaller outer diameter and has a slant surface 17*b*1 which is exposed to the percussion piston chamber 12.

One end of the second portion 17*c* of the second valve 17 is formed to have smaller outer diameter so as to form a third channel 25*a* between the inner surface of the second portion 16*b* of the first valve 16 for connection between the first channels 21 with the valve chamber 18.

Seal members 26*a*, 26*b* such as O-rings are mounted on the outer surfaces of the first portion 17*b* and the second portion 17*c* of the second valve 17, respectively, for keeping air tight between the corresponding inner surfaces of the first valve 16. Further, seal members 26*c*, 26*d* such as O-rings are mounted on the inner surfaces of the first portion 17*b* and the second portion 17*c*, respectively, for keeping air tight between the second portion 9*a*2 of the inner partition wall 9*a*.

When the first and seocnd head valves 16 and 17 are in a position to contact the valve seat 14, the first row or one of the rows of the first channels 21 and the second channels 25 are communicated with each other and are opened to the outlet port 15 and the purcusssion piston chamber 12, respectively. Further, in this position, the first and second head valves 16, 17 prevents communication between the main air chamber 10 and the percussion piston chamber 12 and between the valve chamber 18 and the outlet port 15 through the third channel 25*a* and the second row or another row of the first channels 21. When the first head valve 16 is moved away from the valve seat 14, the second row of the first channels 21 is firstly communicated with the valve chamber 18 through the third channel 25*a*. The first head valve 16 thereafter moves the second head valve 17 through the engagement of the stepped portion 16*c* with the stepped portion 17*a* so as to permit communication between the main air chamber 10 and the percussion piston chamber 12 and to prevent communication between the first row of the first channels 21 and the second channels 25.

A fourth channel 27 is formed through the body housing 2 and the head housing 9. One end of the fourth channel 27 is connected with the valve chamber 18. The other end of the fourth channel 27 is connected with a trigger valve 32 which can be operated to selectively communicate the fourth channel 27 with a trigger valve chamber 28 or with the outside as will be hereinafter described.

Figure 5:
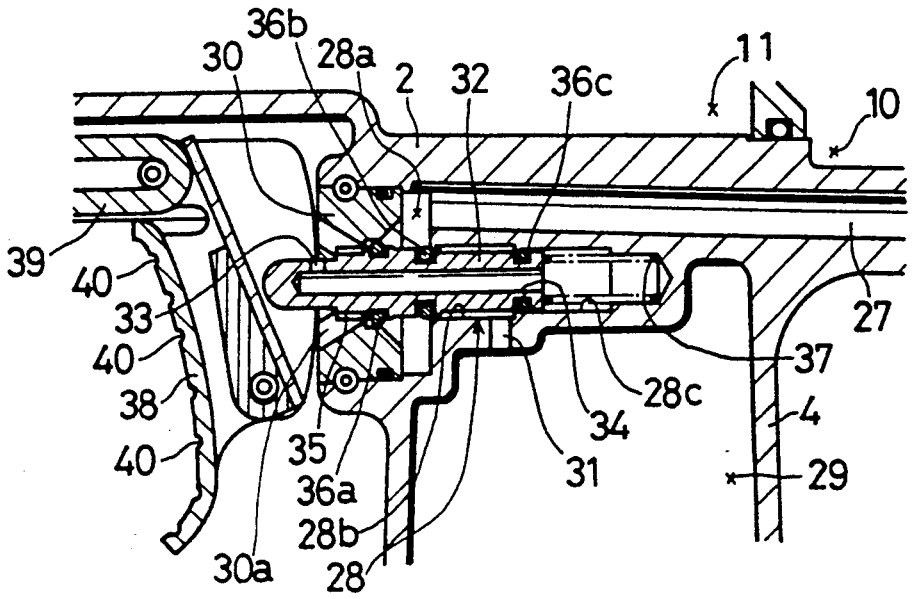
FIG. 5 is an enlarged vertical sectional view of the trigger and the trigger valve shown in FIG. 1.

As shown in FIG. 5, the trigger valve chamber 28 is formed in the uppermost portion of the handle 4. The handle 4 includes therein a second air chamber 29 which is separeted from the trigger valve chamber 28. The trigger valve chamber 28 includes in series a first hole 28*a* opened at one end to the outside, a second hole 28*b* and a third hole 28*c* closed at one end, the diameter of which are in turn gradually reduced. The first hole 28*a* is opened to the fourth channel 27 at the other end. A seal member 30 is inserted into the first hole 28 so as to seal the same from the outside. The second hole 28*b* is connected with the second air chamber 29 through a communication hole 31. The trigger valve 32 is slidably inserted within the trigger valve chamber 28 through the seal member 30. The trigger valve 32 includes a middle portion of large diameter which is permitted to move between the first hole 28*a* and the second hole 28*b* through the seal member 30. One end of the trigger valve 32 having relatively small diameter extends into the third hole 28*c* while the other end thereof also having relatively small diameter is permitted to move in and out of the seal member 30. The trigger valve 32 includes therein a channel 34 which extends in a longitudinal direction and is opened at one end into the third hole 28*c*. A slot 33 is formed at the other end of the trigger valve 32 for communication of the channel 34 with the outside. A space 35 is formed between the trigger valve 32 and the seal member 30 for communication of the first hole 28*a* with the outside through a channel 30*a* formed in the seal member 30. Such communication of the first hole 28*a* with the outside is normally prevented by a seal member 36*a* such as an O-ring. Seal members 36*b* and 36*c* such as O-rings are provided for sealing between the first hole 28*a* and the second hole 28*b*, and between the second hole 28*b* and the third hole 28*c*, respectively. A spring 37 is disposed within the third hole 28*c* for biasing the trigger valve 32 outwardly, and the trigger valve 32 is normally engaged by the seal member 30. In the state shown in FIG. 5, the communication between the first hole 28*a* and the outside is prevented by the seal member 36*a*, and the seal member 36*b* in a position to permit communication between the first hole 28*a* and the second hole 28*b*. A trigger 38 is disposed outside of the handle 4 and can be pulled by the operator for operation of the trigger valve 32. The trigger 38 is associated with a contact arm 39 which constitutes a safety member at the nailing operation. A plurality of grooves 40 are formed on the trigger 38 for preventing slippage of the fingers of the operator.

Thus, when the trigger 38 is not pulled, the compressed air in the second air chamber 29 enters the fourth channel 27 through the communication hole 31, the second hole 28*b* and the first hole 28*a*. When the trigger 38 is pulled to move the trigger valve 32 against the spring 37, the communication between the first hole 28*a* and the second hole 28*b* is prevented by the seal member 36*b* while the communication between the first hole 28*a* and the outside is permitted through the movement of the position of the seal member 36*a*, so that the fourth channel 27 is opened to the outside.

Figure 2:
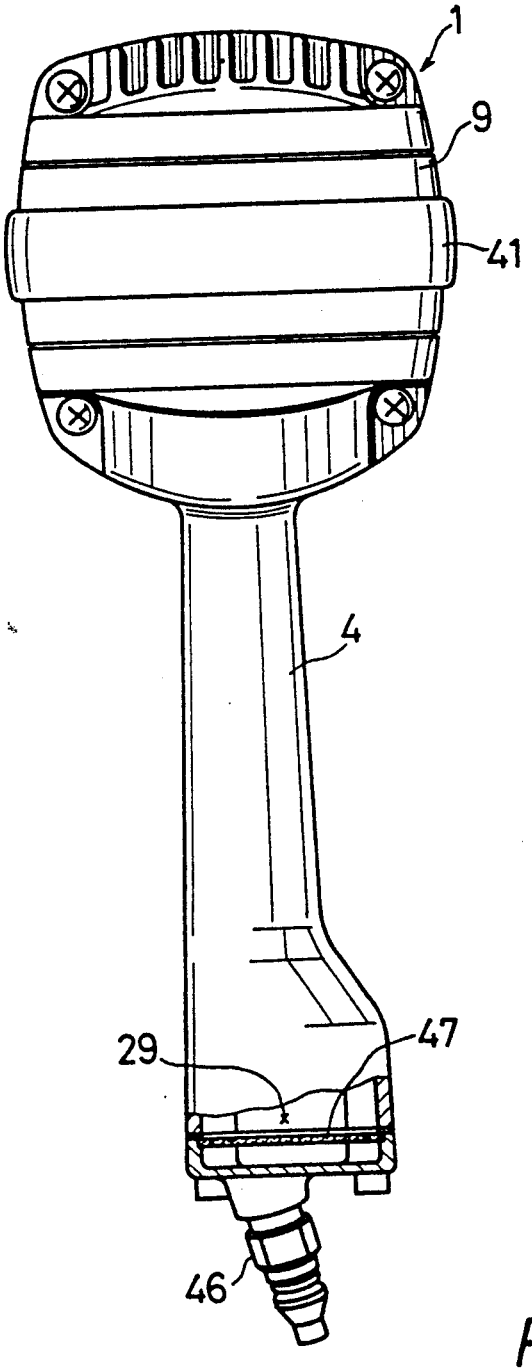
FIG. 2 is a side view of the nailing machine shown in FIG. 1.

As shown in FIGS. 1 and 2, a protective band 41 such as a rubber strip is attached to surround the outer surface of the body housing 2 and the head housing 9 in their longitudinal direction.

A cylindrical cushion member 42 made of rubber etc. is inserted within the inner partition wall 9*a*. The cushion member 42 is opened at one end which abuts on the head housing 9. The other end of the cushion member 42 is closed and adapted to contact the percussion piston 7. A relief hole 43 is formed in the head housing 9 for communication of the interior of the cushion member 42 with the outside.

Figure 3:
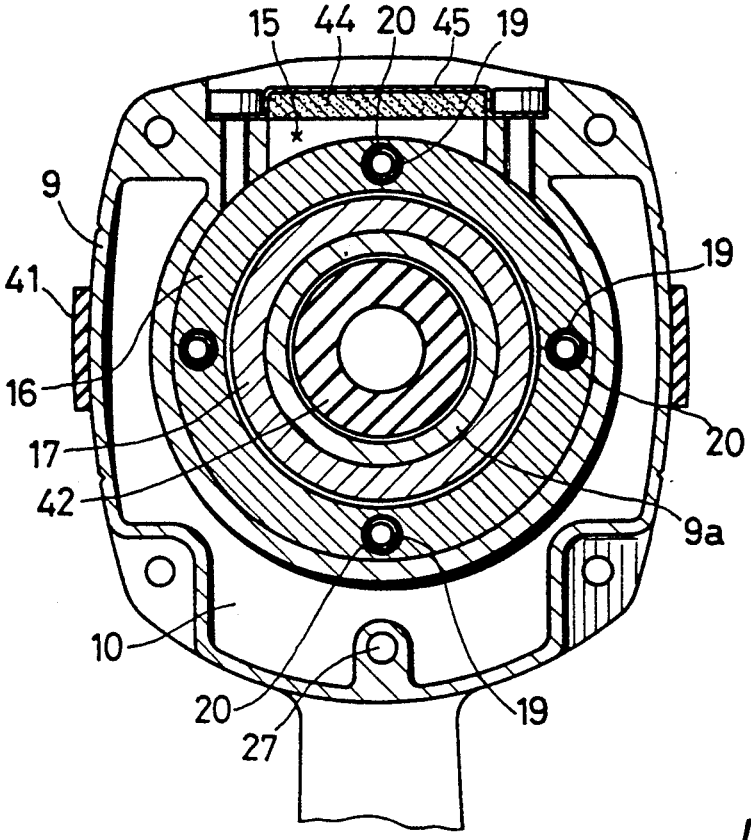
FIG. 3 is an enlarged sectional view of FIG 1 taken along the line III—III.
Figure 4:
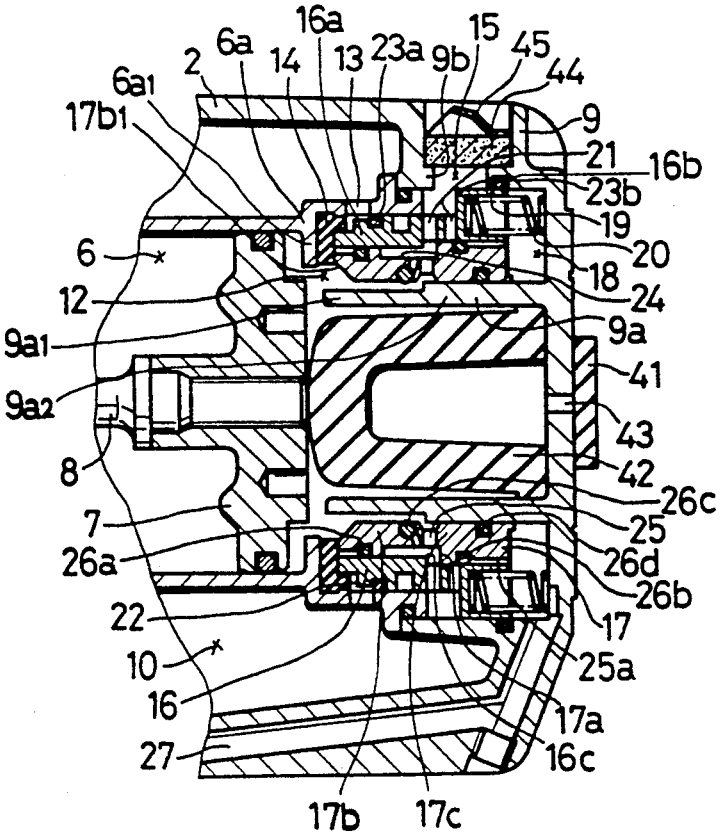
FIG. 4 is an enlarged vertical sectional view of the head valve device shown in FIG. 1.

As shown in FIGS. 3 and 4, a filter 44 is mounted to the outlet port 15 and is covered by a cover member 45.

As shown in FIG. 1, a joint member 46 is mounted on the lower end of the handle 4 for connection with the compressed air source through a hose (not shown). A mesh-like filter 47 made of synthetic resin etc. is disposed within the second air chamber 29 in the vicinity of the joint member 46. The filter 47 is held between a detachable bottom portion of the handle 4 and the other portion of the same.

In operation, when the trigger 38 is not pulled, the compressed air in the second air chamber 29 enters the valve chamber 18 through the trigger valve 32 and the fourth channel 27 and urges the first and second head valves 16 and 17 toward the valve seat 14 as shown in FIG. 4., so that the main air chamber 10 and the percussion piston chamber 12 are prevented from communication therebetween.

In this stage, the biasing force of the spring 20 is applied to the first head valve 16 in addition to the air pressure. The communication between the second row of the first channels 21 and the third channel 25*a* is prevented by the seal member 26*a* between the first head valve 16 and the second head valve 17, so that the communication between the valve chamber 18 and the outlet port 15 is prevented.

When the trigger 38 is pulled so as to move the trigger valve 32 against the spring 27, the fourth channel 27 is communicated with the outside through the trigger valve 32, so that the compressed air in the valve chamber 18 is exhausted to the outside through the fourth channel 27 and the trigger valve chamber 28.

Since the air pressure in the main air chamber 10 is applied to the surface 22 of the first head valve 16 through the communication hole 13, the first head valve 16 is moved against the biasing force of the spring 20 rightwardly in FIG. 4. When the first head valve 16 is moved, the communication between the second row of the first channels 21 and the third channel 25*a* through the movement of the position of the seal member 26*b*, and therefore, the compressed air in the valve chamber 18 is rapidly exhausted from the outlet port 15 through the second row of the first channels 21.

Figure 6:
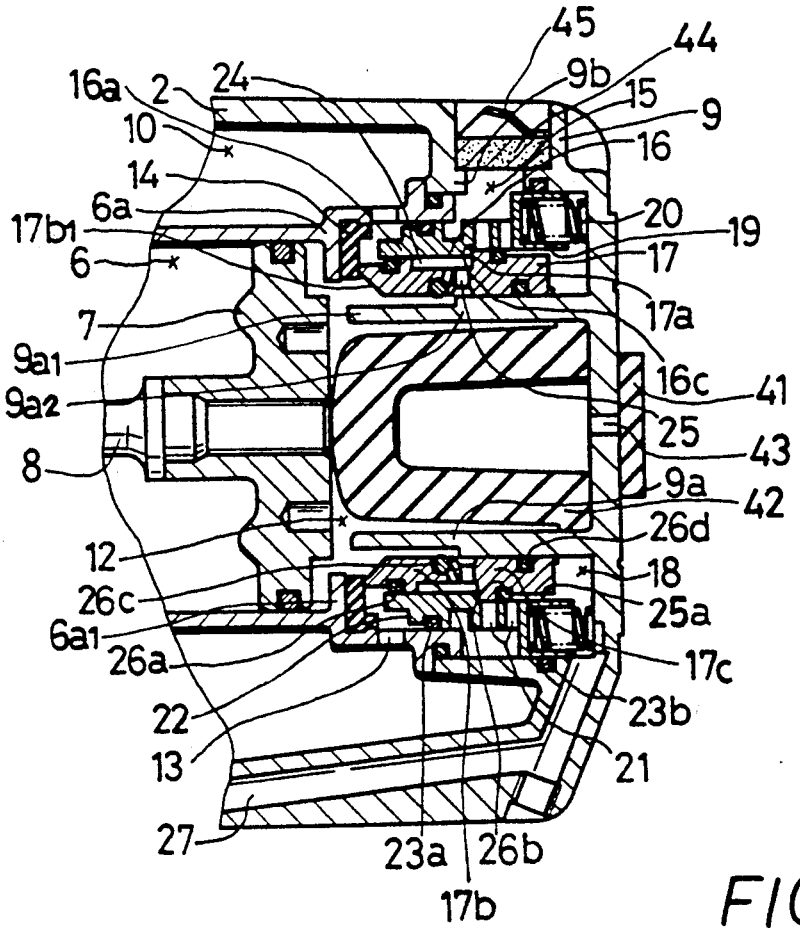
FIGS. 6 to 9 are sectonal views similar to FIG. 4 but showing different operations of the head valve device, respectively.

When the first head valve 16 is further moved rightwardly, the stepped portion 16*c* engages the stepped portion 17*a* of the second head valve 17 so as to move the second head valve 17 therewith as shown in FIG. 6. The first head valve 16 and the second head valve 17 gradually increase the speed of movement by the air pressure applied to their end portions.

When the second head valve 17 is moved rightwardly, the compressed air in the main air chamber 10 flows into the the percussion piston chamber 12 from the beginning. Such air flown into the percussion piston chamber 12 does not further flow into the outlet port 15 through the second channel 25 and the first row of the first channels 21 since the engagement of the stepped portion 16*c* of the first head valve 16 with the stepped portion 17*a* of the second head valve 17 prevents such leakage of the air into the outlet port 15 in the beginning of the movement of the second head valve 17 through its sealing effect.

Figure 7:
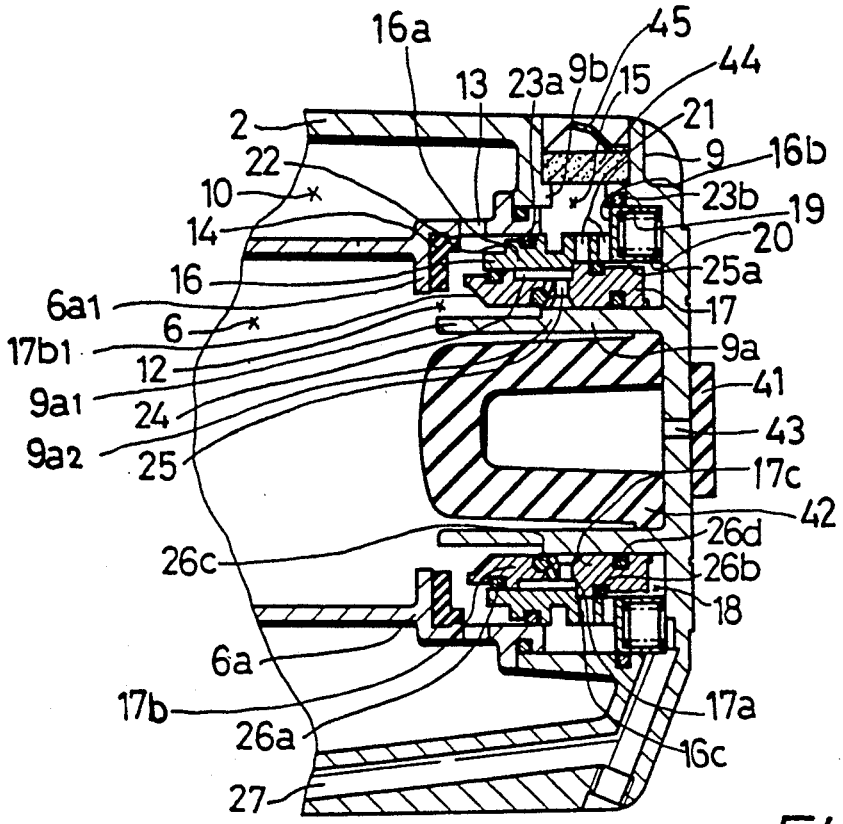

When the second head valve 17 is further moved rightwardly by the first head valve 16 as shown in FIG 7, the seal member 26*c* of the second head valve 17 slidably contacts the second portion 9*a*2 of the inner partition wall 9*a* so as to prevent communication between the percussion piston chamber 12 and the second channel 25, so that the percussion piston chamber 12 can be completely separated from the outside.

Figure 8:
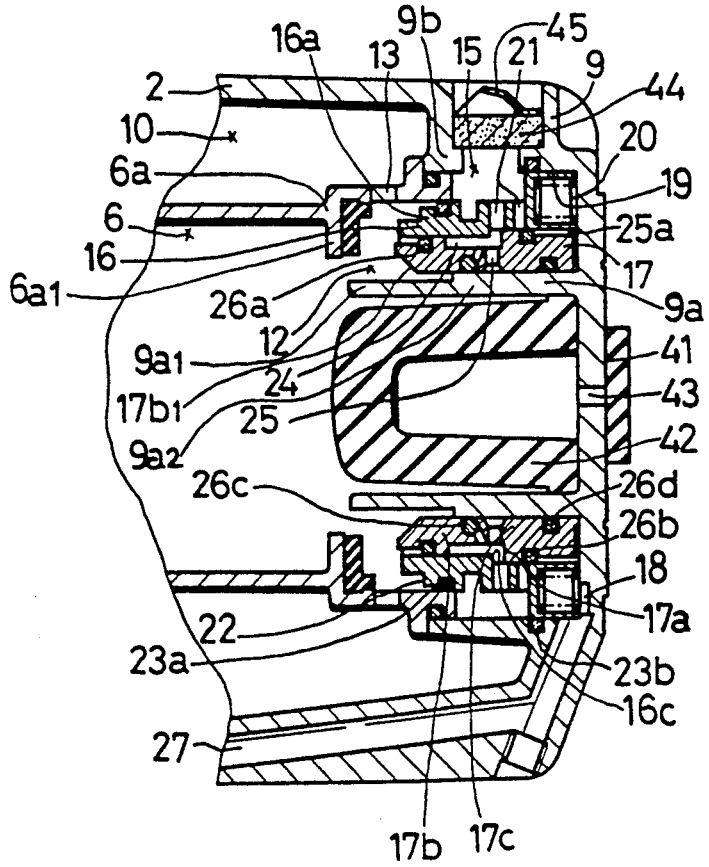

The first head valve 16 terminates its movement by the abutment on the inner wall of the head housing 9 forming the valve chamber 18. The second head valve 17 is thereafter moved further by the pressure of air flown into the percussion piston chamber 12 and terminates its movement by the abutment on the inner wall of the head housing 9 as shown in FIG. 8.

During the movement of the second head valve 17 without assistance of the first head valve 16, the seal member 26*c* is kept in contact with the second portion 9*a*2 of the inner patition wall 9, so that the percusssion piston chamber 12 is completely separated from the outside. Further, when the second head valve 17 reaches its most rightward position as shown in FIG. 8, the seal member 26*b* between the first head valve 16 and the second head valve 17 prevents communication between the second row of the first channels 21 and the third channel 25*a* so that the valve chamber 18 is not communicated with the outlet port 15.

After the first and second head valves 16 and 17 have reached their most rightward position, the compressed air in the main air chamber 10 rapidly enters the percussion piston chamber 12, so that the percussion piston 7 rapidly moves leftwardly for nailing operation.

After the nailing operation, the trigger 38 is released for movement of the trigger valve 32 to return its original position by the force of spring 37, and consequently the communication between the the fourth channel 27 and the outside is prevented while the compressed air in the second air chamber 29 is supplied to the valve chamber 18.

Figure 9:
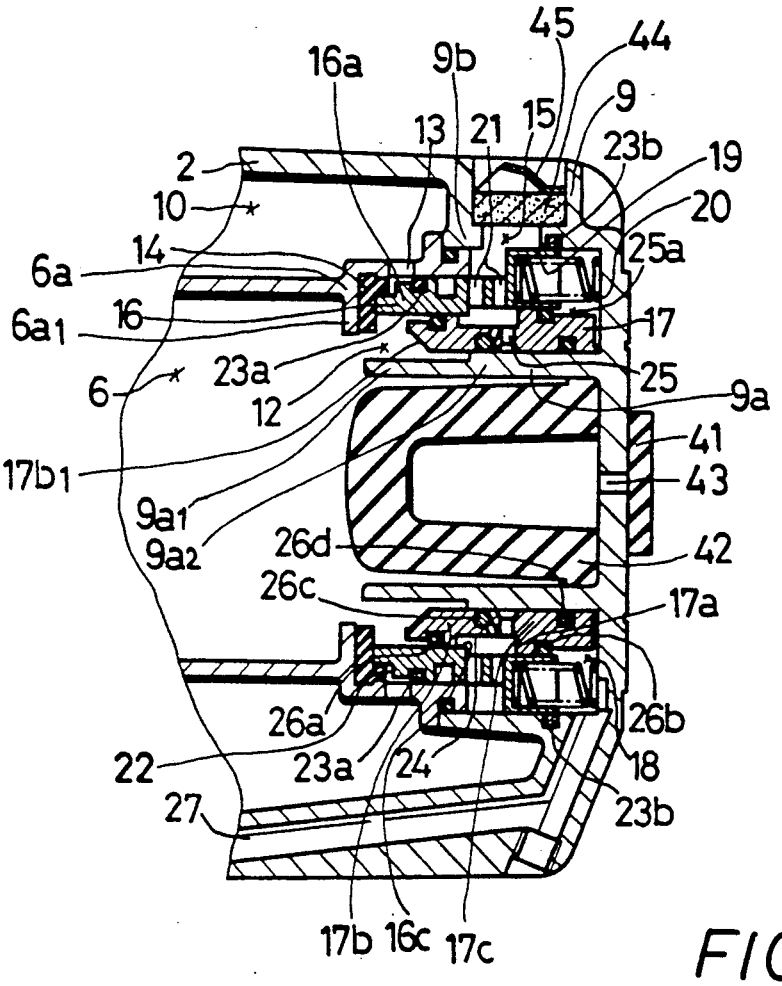

By such supply of the air into the valve chamber 18, the first head valve 16 is firstly moved leftwardly by the pressure of the air and the biasing force of the spring 20. The first head valve 16 is further moved to abut on the valve seat 14 so as to prevent communication between the main air chamber 10 and the percussion piston chamber 12 as shown in FIG. 9.

During such movement of the first head valve 16, the second head valve 17 is kept in position since the first head valve 16 is so constructed that it can move leftwardly in a lower pressure than the pressure which is required for movement of the second head valve 17 in the same direction. Therefore, the seal member 26*b* between the first head valve 16 and the second head valve 17 is kept to prevent communication between the second row of the first channels 21 and the third channel 25*b* during this movement, so that the valve chamber 18 and the outlet port 15 is kept to prevent communication therebetween.

The second head valve 16 is subsequently moved leftwardly by the pressure of air flown into the valve chamber 18, and terminates its movement by abutment on the valve seat 14. When the second head valve 16 is moved in a position where the seal member 26c begins not to contact the second portion 9a2 of the inner partition wall 9a, the second channel 25 communicates with the percussion piston chamber 12, so that the percussion piston chamber 12 communicates with the outlet port 15 through the second channel 25, the recess 24 and the first channels 21. Thus, the compressed air in the percussion piston chamber 12 is exhausted to the outside, and therefore, the percussion piston 7 can be moved rapidly rightwardly to return to its original position as shown in FIG. 4. Since the percussion piston chamber 12 is communicated with the outside after the communication between it and the main air chamber 10 has been completely prevented, any leakage of the compressed air from the main air chamber 10 to the outside can be prevented.

One cycle of the nailing operation is thus completed.

In this embodiment, the protective band 41 made of rubber strip etc. surrounds the outer surface of the body housing 2 and the head housing 9 and extends in their longitudinal direction. With such provision of the protective band, the body housing 2 and the head housing 9 are prevented from a shock even if the nailing machine has been thrown down on the floor of the working place after nailing operation. Further, with the provision of the mesh-like filter 47 in the second air chamber 29 of the handle 4, the dust etc. included in the compressed air supplied from the air source can be prevented to enter the second air chamber 29.

While the invention has been described with reference to a preferred embodiment thereof, it is to be understood that modification or variations may be easily made without departing from the scope of the present invention which is defined by the appended claims.

What is claimed is:

1. A pneumatic percussion tool comprising:

a body;

a cylinder mounted within said body;

a percussion piston connected with a driver for percussion operation and reciprocally movable within said cylinder;

a percussion piston chamber formed in said body and communicating with said cylinder at a stroke end of said percussion piston;

a main air chamber formed in said body for storing compressed air supplied from a compressed air source;

a head valve chamber formed in said body;

a change-over valve operable by an operator for selectively connecting said head valve chamber with said compressed air source or the outside of said body; and a head valve device disposed in said body for interconnecting said percussion piston chamber, said main air chamber, said head valve chamber and the outside of said body;

said head valve device comprising:

first and second head valves disposed in said body and movable in response to the pressure variation in said head valve chamber;

said first and second head valves being positioned at a first position for preventing communication between said main air chamber and said percussion piston chamber while permitting communication between said percussion piston chamber and the outside of said body and preventing communication between said head valve chamber and the outside of said body when the compressed air is introduced into said head valve chamber through said change-over valve;

said first and second head valves being movable from said first position to a second position for permitting communication between said main air chamber and said percussion piston chamber while preventing communication between said percussion piston chamber and the outside of said body and between said head valve chamber and the outside of said body when the compressed air has been discharged to the outside through said change-over valve; and said first and second head valves being moved from said first position to said second position in such a manner that said first head valve firstly moves toward said second position prior to the movement of said second head valve for permitting communication between said head valve chamber and the outside of said body, so that the air within said head valve chamber can be quickly discharged to the outside of said body.

2. The pneumatic percussion tool as defined in claim 1 wherein said first head valves moves from said second position toward said first position prior to the movement of said second head valve by the pressure of the compressed air introduced into said head valve chamber so as to prevent communication between said main air chamber and said percussion piston chamber when said change-over valve is changed to the compressed air source after said first and second head valves have reached said second position, respectively, and wherein said second head valve subsequently moves toward said first position so as to permit communication between said percussion piston chamber and the outside of said body.

3. The pneumatic percussion tool as defined in claim 2 wherein said first and second head valves are coaxial annular member which are slidably movable relative to each other and along corresponding inner and outer walls formed on said body in an axial direction, and wherein said first head valve is movable from said second position toward said first postion by the pressure of air lower than that necessary for moving said first head valve in the same direction.

4. The pneumatic percussion tool as defined in claim 1 wherein said first and second head valves cooperate in such a manner that said second head valve continues to prevent communication between said main air chamber and said percussion piston chamber when said first head valve moves for communication between said head valve chamber and the outside of said body prior to the movement of said second head valve.

5. The pneumatic percussion tool as defined in claim 4 wherein said first and second head valves are coaxial annular member which are slidably movable relative to each other and along corresponding inner and outer walls formed on said body in an axial direction, said first head valve including a surface for receiving a pressure of the compressed air stored in said main air chamber in a direction toward said second position, and wherein means are provided between said first and second head valves for moving said second head valve toward said second position following said first head valve after said first head valve has moved a predetermined distance toward said first position.

6. The pneumatic percussion tool as defined in claim 5 wherein said means for moving said second head valve toward said second position are stepped portions formed on said first and second head valves opposed to each other.

7. The pneumatic percussion tool as defined in claim 5 wherein said second piston is moved by the pressure of the air introduced into said percussion piston chamber to said second position after said first head valve has reached said second position.

8. The pneumatic percussion tool as defined in claim 5 wherein said first head valve is normally biased by a spring toward said first position.

9. The pneumatic percussion tool as defined in claim 5 wherein said first head valve includes two sets of at least one first channel extending in a radial direction and each having one end opened to the outside of said body and the other end opened to said second head valve, said second head valve including at least one second channel extending in a radial direction for communication between said percussion piston chamber and the outside of said body in cooperation with said one of said sets of said first chamber when said first head valve moves from said first position toward said second position until said second head valve follows said first head valve, said first head valve and said second head valve forming therebetween a third channel when said first head valve moves from said first position toward said second position until said second head valve follows said first head valve for communication between said head valve chamber and the outside of said body in cooperation with another set of said first channel.

10. The pneumatic percussion piston as defined in claim 9 wherein said means for moving said second head valve toward said second position are stepped portions formed on said first and second head valves opposed to each other, and wherein the communciation between said one of sets of said first channel with said second channel is prevented through engagement of said stepped portions with each other.

11. The pneumatic percussion tool as defined in claim 10 wherein said second channel is closed by corresponding one of said walls of said body immediately after said second head valve has moved from said first position toward said second position.

12. The pneumatic percussion tool as defined in claim 4 wherein after said first head valve has been moved for communication between said head valve chamber and the outside of the body, said first head valve cooperates with said second head valve to prevent communication between said percussion piston chamber and the outside of said body and simultaneously to move said second head valve toward said second position so as to permit communication between said percussion piston chamber and said main air chamber.

* * * * *